United States Patent [19]

Mariol

[11] Patent Number: 4,515,360

[45] Date of Patent: May 7, 1985

[54] SANDBOX WITH PLAY DECK COVER

[76] Inventor: James F. Mariol, 481 Deanview Dr., Cincinnati, Ohio 45224

[21] Appl. No.: 560,553

[22] Filed: Dec. 12, 1983

[51] Int. Cl.[3] ..... A63G 31/00; A63H 18/00; A63H 23/16

[52] U.S. Cl. ..... 272/1 A; 217/62; 220/351; 446/153

[58] Field of Search ..... 272/1 A; 46/91, 11, 46/13; 190/10, 11; 220/346, 351; 217/62; 446/153

[56] References Cited

U.S. PATENT DOCUMENTS

| | | | |
|---|---|---|---|
| 2,036,076 | 3/1936 | Philippi | 46/91 X |
| 2,473,047 | 6/1949 | Bershad | 190/11 X |
| 2,532,083 | 11/1950 | Brenner | 217/62 |
| 2,609,073 | 9/1952 | McLaughlin | 190/11 |
| 3,006,705 | 10/1961 | Williams et al. | 272/1 A X |
| 4,343,464 | 8/1982 | Dose | 272/1 A X |
| 4,349,983 | 9/1982 | Kilroy et al. | 46/11 X |

FOREIGN PATENT DOCUMENTS

| | | | |
|---|---|---|---|
| 634976 | 1/1962 | Canada | 446/153 |
| 449338 | 6/1936 | United Kingdom | 220/351 |

*Primary Examiner*—Robert A. Hafer
*Assistant Examiner*—Arnold W. Kramer
*Attorney, Agent, or Firm*—Wood, Herron & Evans

[57] ABSTRACT

A sandbox for recreational play is disclosed which has a slidable cover. The cover slides between a closed position covering a container for holding sand to an open position wherein the sand container is uncovered. The cover has a downwardly depending end portion which supports the cover when in the open position, enabling the cover to be used as a play deck. The cover advantageously has an entertaining play surface formed thereon, preferably a miniature marina. To this end, a depression is formed in the cover into which water is received for use with water play toys. A toy vehicle roadway is also formed along the upper portion of the sandbox, and on the cover. The roadway is endless regardless of whether the cover is in either the fully open or fully closed cover position. The container has a channel formed in three of its sidewalls. The ends of the channel are open to the exterior of the container. The cover slides between positions guided by the channel. An upward indentation is formed around three-quarters of the bottom of the cover adjacent the side edge so that with the cover in the closed position, water will drip from the indentation and into the channel and flow out the open ends so as to keep the inside of the container substantially dry.

6 Claims, 4 Drawing Figures

SANDBOX WITH PLAY DECK COVER

FIELD OF THE INVENTION

This invention generally relates to sandboxes for recreational play, and particularly to such sandboxes with covers.

BACKGROUND OF THE INVENTION

It goes without saying that sandboxes for recreational play are generally well known. Such a sandbox would ordinarily include a container for the sand, typically a rectangularly shaped upwardly open box, and perhaps a lip around the upper edge of the sandbox upon which a child using the sandbox can sit.

It is an object of this invention to provide a cover for a sandbox which is slidable between positions covering and uncovering the sandbox.

Another object is to provide such a sandbox cover which, in the uncovered position, forms a play deck to the sandbox.

Yet another object is to provide a cover for a sandbox which has formed thereon an entertaining play surface, such as a miniature marina wherein the cover holds water in a depression therein for water play.

Still another object of the invention is to provide a sandbox with a roadway formed thereon over which toy vehicles can travel, and particularly to provide an endless roadway around the sandbox with the cover in either the sandbox covered or uncovered positions.

SUMMARY OF THE INVENTION

These and other objects are accomplished by this invention in a sandbox for recreational play which includes a cover which further functions as a play deck, and a roadway over which toy vehicles can travel around the periphery of the sandbox. The sandbox of this invention comprises a base having upwardly extending sidewalls and a bottom, with the sidewalls and bottom forming a container for sand. There is a cover for the container which is slidably received in channels formed in the base sidewalls, such that the cover is movable between a closed position wherein the container is covered, to an open position wherein the container is uncovered. A leg portion depends from the cover (remote from the base when in the open position) which serves as a support for the cover when in the open position; the cover thereby further functions as a play deck for the sandbox.

The cover is advantageously provided with an entertaining play surface, which may take the form of a marina, as herein. The marina is made through the provision of a depression in the surface of the cover into which water is received for play, such as with water toys and the like.

A roadway is also advantageously provided around the upper periphery of the base of the sandbox over which toy vehicles can be moved. Portions of roadway are also formed on the cover, which can be used in conjunction with the sandbox base roadway. The sandbox of this invention is most advantageously designed so that the roadway is continuous or endless around the sandbox with the cover in either the open or closed positions, with the further provision of an island formed in the water depression which is spanned by one or more bridges extending from the roadway.

The foregoing objectives, features and advantages of the present invention will be more readily understood upon consideration of the following detailed description of the invention taken in conjunction with the accompanying drawings, in which:

DETAILED DESCRIPTION OF AN EMBODIMENT OF THE INVENTION

Figure 1:
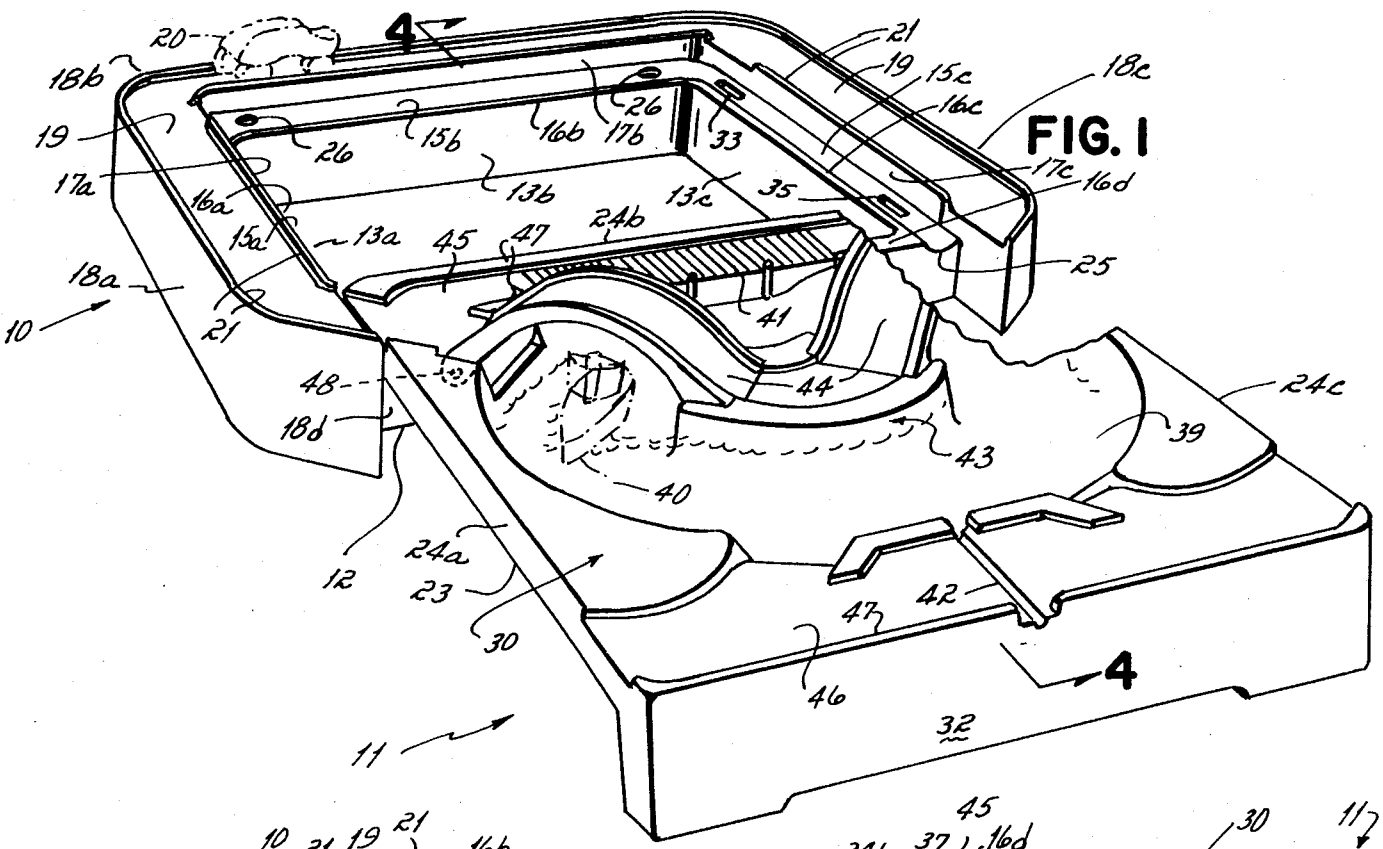
FIG. 1 is a perspective view of a sandbox made in accordance with the teachings of this invention showing the cover in the open (uncovered) position.

One embodiment of a recreational sandbox made according to this invention has a base for containing sand, here generally designated by the numeral 10, and a cover, here generally designated by the numeral 11. The base 10 has a relatively flat bottom 12 and substantially vertical upright interior sidewalls 13*a–d*, which together form a box-like container for receiving and holding sand therein.

Horizontal channels 15*a–c* are formed around the upper edge of the sidewalls 13*a–c*, having an inner lip 16*a–c*. No channel is formed on the upper edge of sidewall 13*d*, which simply terminates in a top edge 16*d*. Relatively short interior vertical sidewalls 17*a–c* extend upwardly from the outboard sides of channels 15*a–c*, respectively.

Exterior sidewalls 18*a–d* are outwardly spaced from the inner sidewalls 13*a–d*. Exterior sidewalls 18*a–c* extend in height from approximately the bottom to top of the base 10 (top of sidewalls 17*a–c*), while exterior sidewall 18*d* is approximately the height of inner sidewall 13*d*. A generally horizontal shelf 19 is provided between the upper edges of the short inner sidewalls 17*a–c* and the upper edges of exterior sidewalls 18*a–c*. Herein, this shelf 19 forms a roadway which extends around three sides of the base 10 over which wheeled toy vehicles 20 may travel. To this end, short vertical abutments or curbs 21 are provided along the side edges of the shelf 19, which may simply be vertical extensions of the sidewalls 17*a–c* and 18*a–c*.

Figure 3:
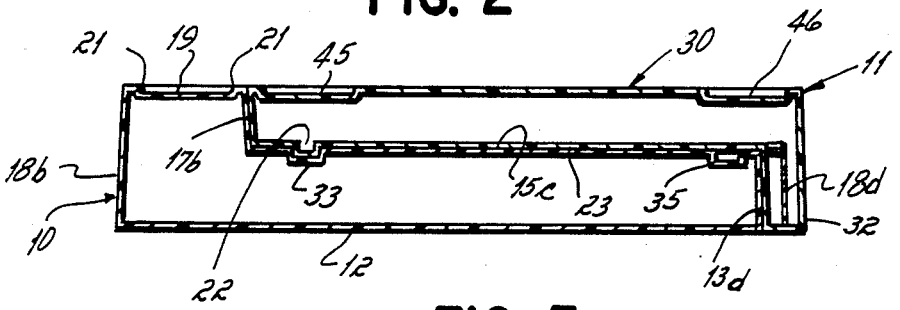
FIG. 3 is a cross-sectional view taken along line 3—3 of FIG. 2.

The channels 15*a–c* form a continuous channel which extends around three sides of the interior of base 10. This channel serves two primary functions. In one instance, the parallel side channels 15*a* and 15*c* receive protuberances 22 (FIG. 3) which depend from the bottom or lower surface 23 of the cover 11 along side edges 24*a* and 24*c*. Secondly, the channel (15*a–c*) forms a trough to catch water, such as rain water, which may flow into the gap between the cover 11 and base 10 when the cover is closed (phantom or chain dotted line in FIG. 4). Water passing into this trough is channeled away to pour out of the open ends of the channels 15*a* and 15*c*, as at channel end 25 (channel end for 15*a* not shown). Drain holes 26 are also provided in the bottom of the channels 15*a–c*, as is deemed necessary for sufficient drainage. Sand in the sandbox thus remains dry with the cover 11 closed should water flow around the edge of the cover.

The cover 11 has an upper or top surface 30, a lower or bottom surface 23, and sides 24*a–c* and side 32. Side 32 has a major portion which depends from the cover 11, and is considerably taller than sides 24*a*, 24*b* and 24*c*.

Figure 4:
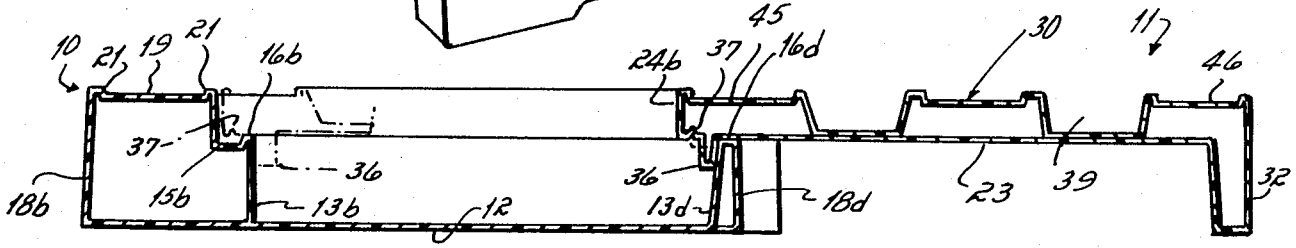
FIG. 4 is a cross-sectional view taken along line 4—4 of FIG. 1.

Side 32 forms a support for the cover 11 in the open position, as shown in FIGS. 1 and 4, and is aproximately equal in vertical height to that of outer sidewalls 18*a–c* of base 10. The side 32 has sufficient thickness to provide a sturdy support for the cover 11 when in the open position. It will thus be seen that the cover functions as a play deck for the sandbox base 10 when in the open position. The cover 11 is sized to fit within the inner perimeter of the sandbox base 10 defined by inner sidewalls 17*a–c*, with cover side edges 24*a–c* abutting or nearly abutting against the sidewall edges 17*a–c*. Detents 33 (only one of which is shown herein) are provided in the channels 15*a* and 15*c* near the side wall 17*b*. The detents 33 receive the protuberances 22 (FIG. 3) which depend from the bottom 23 of the cover along side edges 24*a* and 24*c* near the corners adjacent cover side edge 24*b*. The sandbox is covered by simply sliding cover 11 along channels 15*a* and 15*c* on the protuberances 22 until the protuberances 22 drop into the detents 33. It will be noted that the cover 11 can be simply lifted free of the base 10, if desired.

Additional detents 35 are further provided at the opposite end of channels 15*a* and 15*c* from the detents 33, which detents 35 receive the protuberances 22 when the cover is in the open or uncovered position.

The cover 11 also has a stop portion 36 which depends from the bottom 23 of the cover. The stop portion 36 runs parallel to the side edge 24*b* of the cover and is spaced slightly inwardly therefrom along the bottom 23. This stop portion 36 abuts interior sidewall 13*b* of the base 10 when the cover is in the closed position, and abuts against interior sidewall 13*d* when the cover is in the open position. A relatively sturdy support connection between the cover 11 and the base 10 is thus maintained by a combination of the wall abutting stop portion 36 and the protuberances 22 when engaged in the detents 35, thus providing a relatively safe play deck area.

The cover 11 also features a slight upward continuous indentation 37 which is formed along the bottom 23 of the cover closely adjacent the side edges 24*a*, 24*b* and 24*c*. This indentation 37 forms a drip edge along these three sides of the cover. Water flowing in the gap between the cover 11 and the base 10 with the cover closed, as along side edges 24*a–c* of the cover, will drip from the cover closely adjacent the side edges and into the trough formed by the channels 15*a*, 15*b* and 15*c* due to the surface discontinuity provided by the indentation 37.

The upper surface 30 of cover 11 is advantageously provided with an interesting play area, which here takes the form of a miniature marina. To this end, the cover 11 has a somewhat kidney shaped depression 39 formed in the upper surface 30 which can receive and hold water therein. Floating toys 40 can be used in the water. Other aspects of a marina, such as a dock 41, may additionally be provided. An overflow channel 42 extends from the upper edge of the depression 39 to the side 32 of the cover to channel away water if the depression 39 becomes overfilled.

To add to the entertainment value of the marina play deck formed in the cover 11, an island 43 is provided within the depression 39, and bridges 44 span the distance between the island 43 and a roadway portion 45. This roadway portion 45 is formed in the top of the cover 11 running adjacent to side edge 24*b* of the cover. Another portion of roadway indicated at 46 is also provided on the cover running along side 32 of the cover. Each roadway 45 and 46 has a side edge or curb portion 47 which corresponds to the curb portion 21 of the base 10. The bridges 44 can advantageously be made to be vertically pivotable, such as through the use of pivot pins 48 formed on one base of each of the bridges, which pins are received in detents (not shown) formed in the cover 11.

Figure 2:
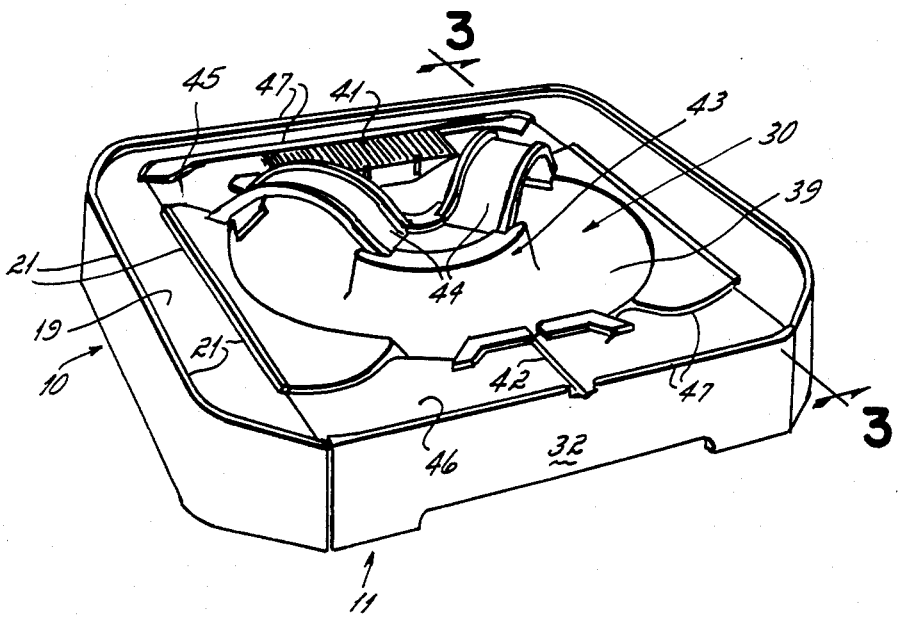
FIG. 2 is a view similar to FIG. 1 with the cover in the closed (covered) position.

Provision of roadways 45 and 46 on the cover 11 yields a continuous roadway around the sandbox with the cover in the closed position (FIG. 2) or in the open position (FIG. 1). When closed, a continuous roadway around the sandbox is formed by base roadway 19 and cover roadway portion 46. Additionally, a subsidiary marina roadway is provided between the two parallel sides of base roadway 19 connected via cover roadway portion 45. With the cover in the open position, cover roadway portion 45 serves to interconnect the two ends of base roadway 19.

Thus, while the invention has been described in connection with a certain presently preferred embodiment, it will be immediately obvious to those skilled in the art many modifications of structure, arrangement, portions, elements, materials, and components can be used in the practice of the invention without departing from the principles of this invention.

What is claimed is:

1. A sandbox for recreational play comprising, a base having upright sidewalls and a bottom, the sidewalls and the bottom forming a container for sand, and a rigid cover for the container, the cover being slidably received in channels formed in the base sidewalls for movement between a first generally horizontal position wherein the container is covered to a second generally horizontal position wherein the container is uncovered, the cover further including a downwardly depending portion which serves as a support for one end of the cover when in the second position, the opposite end of the cover being supported by the base in the second position such that the cover functions as a play deck for the sandbox when in the second position, said cover having a depression formed therein for receiving water and water toys in both the first and second positions of the cover.

2. The sandbox of claim 1 wherein the base and the cover have a roadway formed thereon over which toy vehicles can travel, a portion of the roadway being formed on the cover and another portion of the roadway being formed on the base, the roadway being substantially continuous around the perimeter of the container with the cover in the first or second position.

3. The sandbox of claim 1 wherein the base and the cover have a roadway formed thereon over which toy vehicles can travel, and further including an island formed in the depression, and at least one bridge spanning the island and roadway.

4. The sandbox of claim 1 wherein said channels formed in the base sidewalls are upwardly open, generally coplanar and interconnected along the interior of the container, at least one of said channels being open-ended, said channels serving to drain off water flowing into the base from off of the cover, and wherein the cover has a top, a bottom, and a side edge, the bottom of the cover having means thereon for disrupting a flow of water over the cover bottom such that the flow of water is caused to drip from the cover at the means and into said channels when the cover is in the first position so as to keep the container substantially dry.

5. The sandbox of claim 4 wherein the means for disrupting the water flow is an indentation in the bottom of the cover extending around the cover adjacent the side edge thereof which is vertically aligned with said channels formed in the base sidewalls with the cover in the first (covered) position, such that water is caused to drip from the cover into the channels.

6. A sandbox for recreational play comprising, a base having upright sidewalls and a bottom, the sidewalls and bottom forming a rectangular container for sand, a rigid cover having a top and a bottom with a permanent depression formed on the cover top for receiving water and water toys, and an island formed in the depression, a generally coplanar channel formed in the base and extending along three of the four sidewalls around the interior of the container, at least one end of the channel being open-ended, said cover being slidably received on said channel for movement on said base between a first generally horizontal position wherein the container is covered to a second generally horizontal position wherein the container is uncovered, the cover further including a downwardly depending portion which serves as a support for the cover when in the second position, the opposite end of the cover being supported by the base in the second position such that the cover functions as a play deck for the sandbox when in the second position, said cover further having an upwardly extending indentation formed around three-quarters of its bottom adjacent the cover's side edge, the indentation being vertically aligned with the channel formed in the base sidewalls with the cover in the first (covered) position, the indentation disrupting water flow around the cover causing the water to drip from the cover into the channel and out the open end so as to keep the container substantially dry, said cover top having a portion of a roadway formed thereon and the base having another portion of the roadway formed thereon, the roadway formed extending around the entire perimeter of the container, the roadway being continuous in both the first or second positions.

* * * * *